US008203465B2

(12) United States Patent
Shafaat et al.

(10) Patent No.: US 8,203,465 B2
(45) Date of Patent: Jun. 19, 2012

(54) FILTERING AIRCRAFT TRAFFIC FOR DISPLAY TO A PILOT

(75) Inventors: Syed Tahir Shafaat, Everett, WA (US); Tan N. Che, Federal Way, WA (US); Minh-Tri Le, Lynnwood, WA (US)

(73) Assignee: The Boeing Company, Chicago, IL (US)

( * ) Notice: Subject to any disclaimer, the term of this patent is extended or adjusted under 35 U.S.C. 154(b) by 408 days.

(21) Appl. No.: 12/501,656

(22) Filed: Jul. 13, 2009

(65) Prior Publication Data

US 2011/0006918 A1 Jan. 13, 2011

(51) Int. Cl.
*G08B 21/00* (2006.01)

(52) U.S. Cl. ..... 340/971; 340/945; 340/963; 701/301; 342/29; 342/455

(58) Field of Classification Search ..... 340/971, 340/945, 963, 964; 701/207, 220, 300, 301, 701/302; 342/29, 30, 118, 147, 176, 455
See application file for complete search history.

(56) References Cited

U.S. PATENT DOCUMENTS

| | | | | |
|---|---|---|---|---|
| 5,636,123 | A * | 6/1997 | Rich et al. | 701/207 |
| 5,872,526 | A * | 2/1999 | Tognazzini | 340/961 |
| 6,201,482 | B1 * | 3/2001 | Schiefele et al. | 340/961 |
| 6,459,411 | B2 * | 10/2002 | Frazier et al. | 342/455 |
| 6,531,978 | B2 * | 3/2003 | Tran | 342/29 |
| 6,690,296 | B2 * | 2/2004 | Corwin et al. | 340/961 |
| 6,985,103 | B2 * | 1/2006 | Ridderheim et al. | 342/30 |
| 7,382,285 | B2 * | 6/2008 | Horvath et al. | 340/961 |
| 7,696,904 | B2 * | 4/2010 | Horvath et al. | 340/961 |

FOREIGN PATENT DOCUMENTS

| | | | |
|---|---|---|---|
| EP | 2 071 543 | A2 | 6/2009 |
| GB | 2 201 062 | A | 8/1988 |
| WO | 03/060855 | A1 | 7/2003 |
| WO | 2006/104776 | A1 | 10/2006 |

OTHER PUBLICATIONS

European Patent Office, International Search Report and The Written Opinion of the International Searching Authority for International Application No. PCT/US2010/041496, dated Nov. 3, 2010.
RTCA, Inc., Safety, Performance and Interoperability Requirements Document for the In-Trail Procedure in Oceanic Airspace (ATSA-ITP) Application, Jun. 19, 2008.
Wikipedia, Automatic dependent surveillance-broadcast, http://en.wikipedia.org/wiki/Automatic_Dependent_Surveillance-Broadcast, printed May 1, 2009.

* cited by examiner

*Primary Examiner* — Toan N Pham
(74) *Attorney, Agent, or Firm* — Charles L. Moore; Moore & Van Allen PLLC

(57) ABSTRACT

A method for filtering and presenting relevant aircraft traffic to a pilot may include determining a location and altitude of aircraft within a predetermined airspace relative to the pilot's own aircraft. The method may also include presenting a representation of the pilot's own aircraft and a representation of the location of each of the aircraft within the predetermined airspace in relation to the pilot's own aircraft on a display to the pilot. The method may additionally include filtering relevant aircraft within a selected filtering airspace relative to the pilot's own aircraft. The method may further include presenting the representation of the relevant aircraft within the selected filtering airspace in a selected format to distinguish the relevant aircraft within the selected filtering airspace from any other aircraft that may be presented in the display.

20 Claims, 6 Drawing Sheets

500
326
328
48000
32000
16000
80
40
0
40
80
334
332
302
312a
312b
339
SNS
LIN
308
310
306
304
302
504
312b
20
20
6
12
18
24
30
33
36
3
6
9
12
15
18
21
24
27
30
33
36
3
6
9
12
15
18
21
24
27
30
33
36
3
6
9
12
15
18
21
24
27

600

| FLIGHT ID | BEARING | RANGE | ALTITUDE | OTHER DATA |
|---|---|---|---|---|
| ***D 100*** | ***90*** | **5** | **32** | |
| A 232 | 345 | 8 | 37 | |
| NW 586 | 125 | 4 | 30 | |
| | | | | |

602

FIG. 6

FILTERING AIRCRAFT TRAFFIC FOR DISPLAY TO A PILOT

FIELD

The present disclosure relates to aerospace vehicles or aircraft and avionics for interfacing with such vehicles, and more particularly to filtering aircraft traffic for display to a pilot for situational awareness and control of the pilot's own ship or aerospace vehicle.

BACKGROUND

The development and implementation of Automatic Dependent Surveillance-Broadcast (ADS-B) technology around the world is expected to provide more operationally efficient airspace. In this environment, aircraft would be able to change their flight level during cruise in oceanic and procedural airspace for optimum flight level for better fuel consumption (better airplane performance), favorable winds (e.g. better tail wind), to avoid turbulence or due to presence of weather at the current flight level, and for other reasons.

During the cruise phase of a flight, the range on a navigation display (ND) is generally set by the flight crew to a much higher range than during other phases of flight, such as approach and departure from an airport or other air traffic congested area. At these high display ranges, displaying all the aircraft traffic can cause clutter and make it difficult and cumbersome for the flight crew to determine which aircraft traffic is of concern without evaluating each aircraft individually. This may involve evaluating a current altitude, range, direction of travel, vertical trend and other flight data provided for each aircraft. If all of the traffic is displayed on a display, such as a Vertical Situational Display (VSD) or other air traffic display device or system, the display of large numbers of aircraft in the vicinity can represent a significant work load for the flight crew. Additionally, such displays generally occupy a relatively small limited space on a cockpit display panel which can exacerbate efficient evaluation by the flight crew of the aircraft traffic situation around their own aircraft.

SUMMARY

In accordance with an embodiment, a method for filtering and presenting relevant aircraft traffic to a pilot may include determining a location and altitude of aircraft within a predetermined airspace relative to the pilot's own aircraft. The method may also include presenting a representation of the pilot's own aircraft and a representation of the location of each of the aircraft within the predetermined airspace in relation to the pilot's own aircraft on a display to the pilot. The method may additionally include filtering the relevant aircraft within a selected filtering airspace relative to the pilot's own aircraft. The method may further include presenting the representation of the relevant aircraft within the selected filtering airspace in a selected format to distinguish the relevant aircraft within the selected filtering airspace from any other aircraft presented in the display.

In accordance with another embodiment, an aircraft may include an airframe and a system for filtering and presenting relevant aircraft traffic to a pilot of the aircraft. The system may include an electronic device for determining a location and altitude of aircraft within a predetermined airspace relative to the pilot's own aircraft. The system may also include a display to present a representation of the pilot's own aircraft and a representation of the location of each of the aircraft within the predetermined airspace in relation to the pilot's own aircraft. The system may further include a traffic filtering module to filter the relevant aircraft within a selected filtering airspace relative to the pilot's own aircraft. The traffic filtering module may also be adapted to present the representation of the relevant aircraft within the selected filtering airspace in a selected format to distinguish the aircraft within the selected filtering airspace from any other aircraft presented in the display.

In accordance with another embodiment, a computer program product for filtering and presenting relevant aircraft traffic to a pilot includes a computer readable storage medium having computer readable program code embodied therewith. The computer readable program code embodied on the computer readable storage medium may include computer readable program code configured to determine a location and altitude of aircraft within a predetermined airspace relative to the pilot's own aircraft. The computer readable program code may also include computer readable program code configured to present a representation of the pilot's own aircraft and a representation of the location of each of the aircraft within the predetermined airspace in relation to the pilot's own aircraft on a display to the pilot. The computer readable program code may additionally include computer readable program code configured to filter relevant aircraft within a selected filtering airspace relative to the pilot's own aircraft. The computer readable program code may further include computer readable program code configured to present the representation of the relevant aircraft within the selected filtering airspace in a selected format to distinguish the relevant aircraft within the selected filtering airspace from any other aircraft presented in the display.

Other aspects and features of the present disclosure, as defined solely by the claims, will become apparent to those ordinarily skilled in the art upon review of the following non-limited detailed description of the disclosure in conjunction with the accompanying figures.

BRIEF DESCRIPTION OF THE SEVERAL VIEWS OF THE DRAWINGS

The following detailed description of embodiments refers to the accompanying drawings, which illustrate specific embodiments of the disclosure. Other embodiments having different structures and operations do not depart from the scope of the present disclosure.

FIG. 6 is an example of a presentation in a display of a representation of aircraft traffic in a tabular form and representation of aircraft within a selected filtering airspace of a pilot's own aircraft in a selected format to distinguish from other aircraft in the display in accordance with an embodiment of the disclosure.

DESCRIPTION

Figure 1:
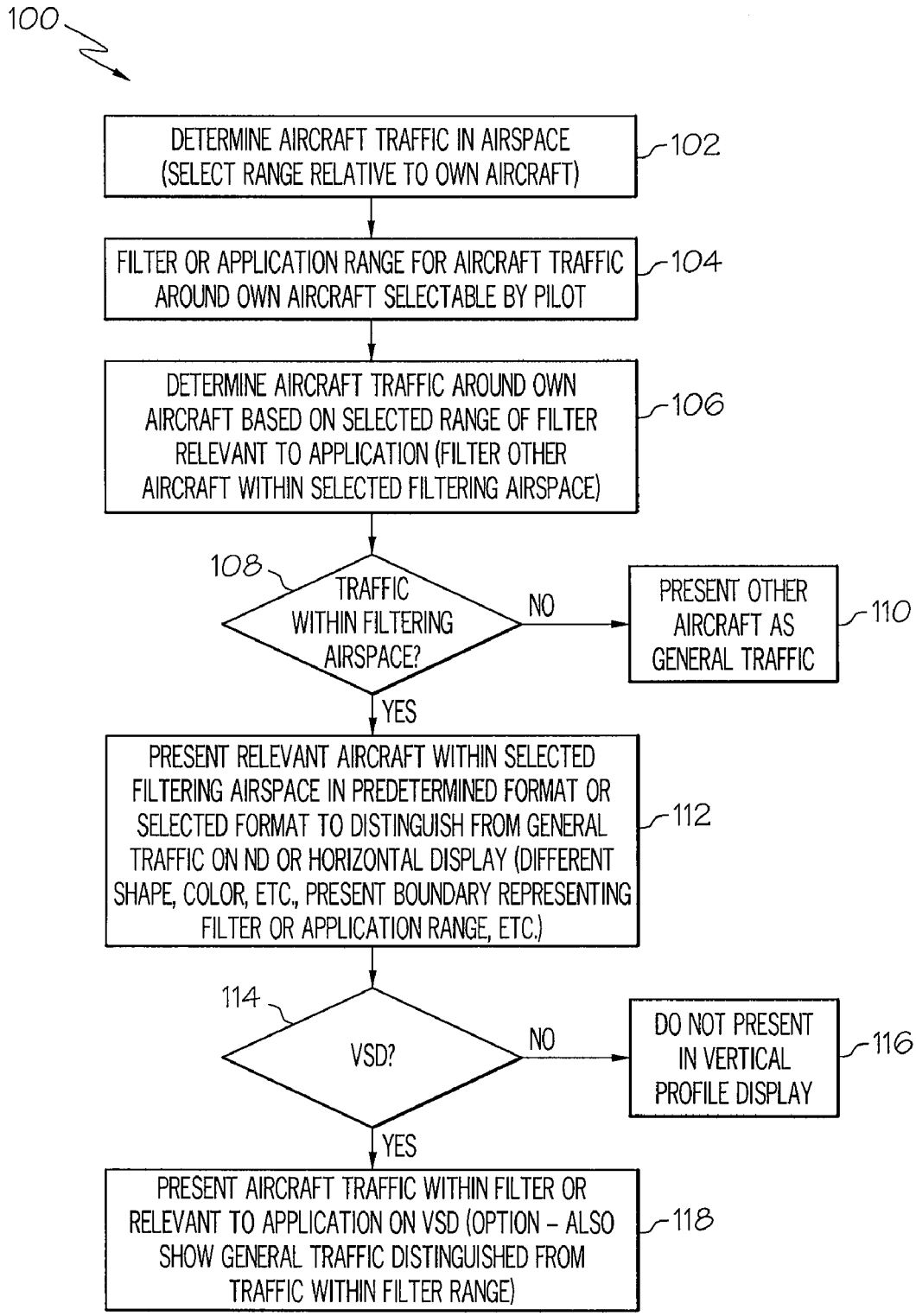
FIG. 1 is a flow chart of an example of a method for filtering relevant aircraft traffic and presenting the filtered traffic to a pilot in accordance with an embodiment of the present disclosure.

The following detailed description of embodiments refers to the accompanying drawings, which illustrate specific embodiments of the disclosure. Other embodiments having different structures and operations do not depart from the scope of the present disclosure.

As will be appreciated by one of skill in the art, the present disclosure may be embodied as a method, system, or computer program product. Accordingly, the present disclosure may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the present disclosure may take the form of a computer program product embodied in one or more computer readable storage medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present disclosure are described below with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

As used herein, relevant aircraft, relevant traffic, relevant aircraft traffic, or filtered aircraft or traffic may be defined as the traffic in an airspace that is of interest to the pilot or flight crew and/or is being evaluated by an application for providing some predetermined functionality. For example, the application for providing some predetermined functionality may include an application, module, or similar means for providing aircraft or traffic spacing and general situational awareness and which may include filtering aircraft traffic similar to that described herein.

Other aircraft, other traffic, or other relevant aircraft traffic used herein to define traffic that is present in the airspace around a pilots own aircraft or ownship that is not of interest or concern to the pilot or flight crew at a given time, or is not being used by an application for providing some functionality as described herein other than general situational awareness.

FIG. 1 is a flow chart of an example of a method 100 for filtering relevant aircraft traffic and presenting the filtered traffic or relevant aircraft to a flight crew or pilot in accordance with an embodiment of the present disclosure. In block 102, aircraft traffic in a predetermined airspace relative to a pilot's own aircraft or ship may be determined. A range of the predetermined airspace for determining the aircraft traffic may be selected by the pilot or flight crew. Examples of information that may be gathered, obtained or determined with respect to the aircraft traffic or each of the relevant aircraft and other aircraft within the predetermined airspace may include but is not necessarily limited to a location of each of aircraft relative to the pilot's own aircraft, a current altitude, a direction of flight or heading, a vertical trend, airspeed, type of each aircraft, identity of each aircraft and other information that may be of interest or helpful to the flight crew of the aircraft.

In block 104, a filter or application range for filtering aircraft traffic or relevant aircraft within a selected filtering airspace around the aircraft may be selected by the flight crew. The selected filtering airspace will generally be a smaller airspace than the predetermined airspace for determining the aircraft traffic in block 102.

In block 106, relevant aircraft or aircraft traffic within the selected filtering airspace corresponding to the selected filter range or application range relative to the pilot's own aircraft may be determined.

In block 108, a determination may be made if relevant aircraft are within the selected filtering airspace or range. If no relevant aircraft are within the selected filtering airspace, a representation of the other aircraft may be presented in a cockpit display to the flight crew as general traffic in block 110. In other words, all of the other aircraft may be presented or represented in the cockpit display in the same format without distinguishing one from another.

If a determination is made in block 108 that relevant aircraft or aircraft traffic is within the selected filtering airspace, filter range, or application range, the method 100 may advance to block 112. In block 112, a representation of the relevant aircraft within the selected filtering airspace may be presented in a display to the flight crew in a predetermined format to distinguish from the general aircraft traffic or other aircraft outside of the selected filtering airspace or range. Examples of different predetermined formats to distinguish other aircraft within the selected filtering airspace will be described in more detail with reference to the exemplary displays in FIGS. 3, 4, 5 and 6. Briefly, examples of the representation of the relevant aircraft within the selected filtering airspace to distinguish between other aircraft being presented in the display may include but is not necessarily limited to representing the relevant aircraft within the selected filtering airspace in a different color and/or a different shape compared to other aircraft in the display. The relevant aircraft within the selected filtering airspace may also have an icon associated with each representation of an aircraft to distinguish from other aircraft in the display. The icon may be in addition to other features or in place of other features to distinguish relevant aircraft within the selected filtering airspace from other aircraft being represented in the display.

Figure 3:
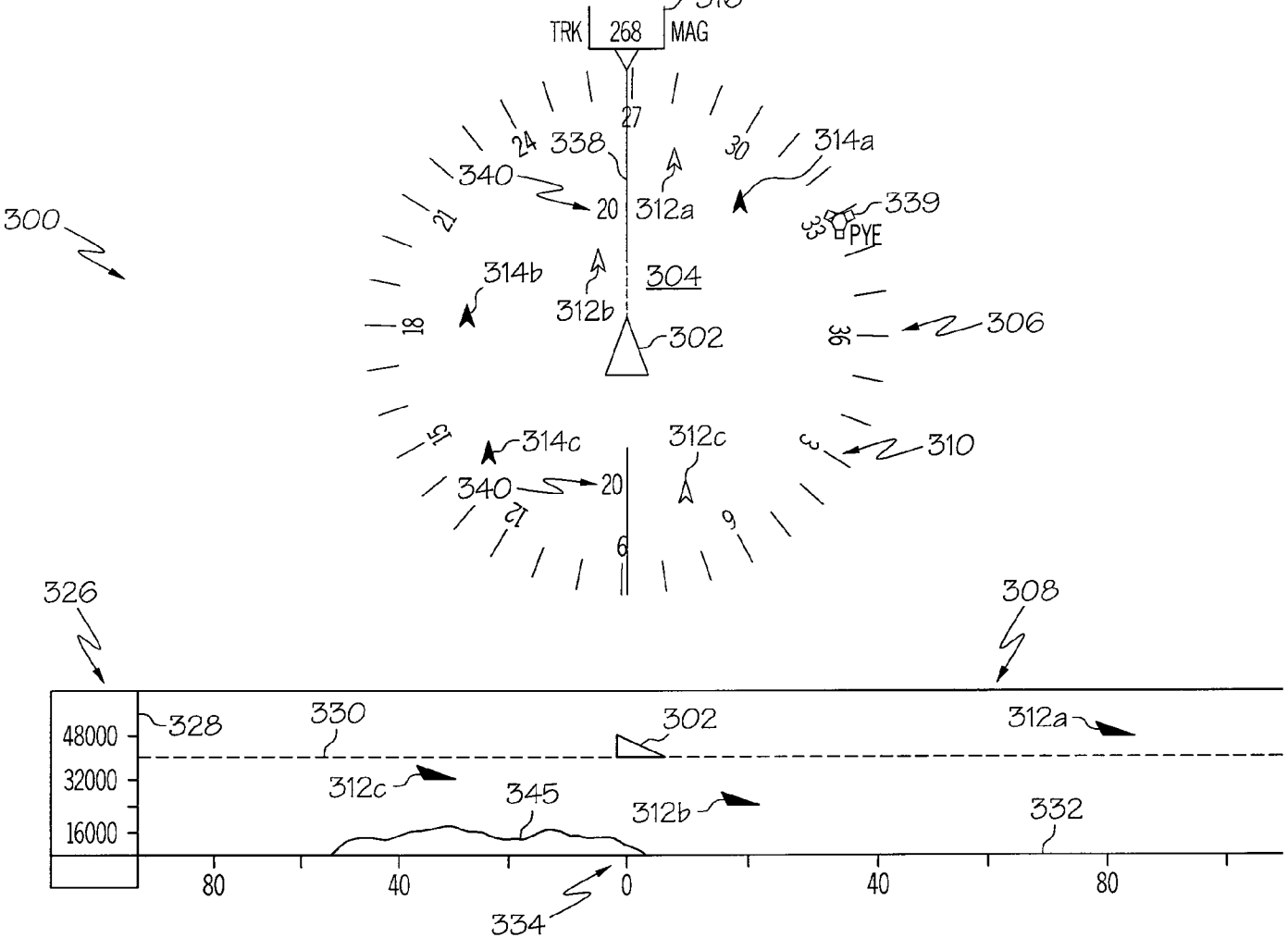
FIG. 3 is an illustration of an exemplary display for filtering relevant aircraft traffic and presenting the filtered traffic to a pilot in accordance with an embodiment of the present disclosure.
Figure 4:
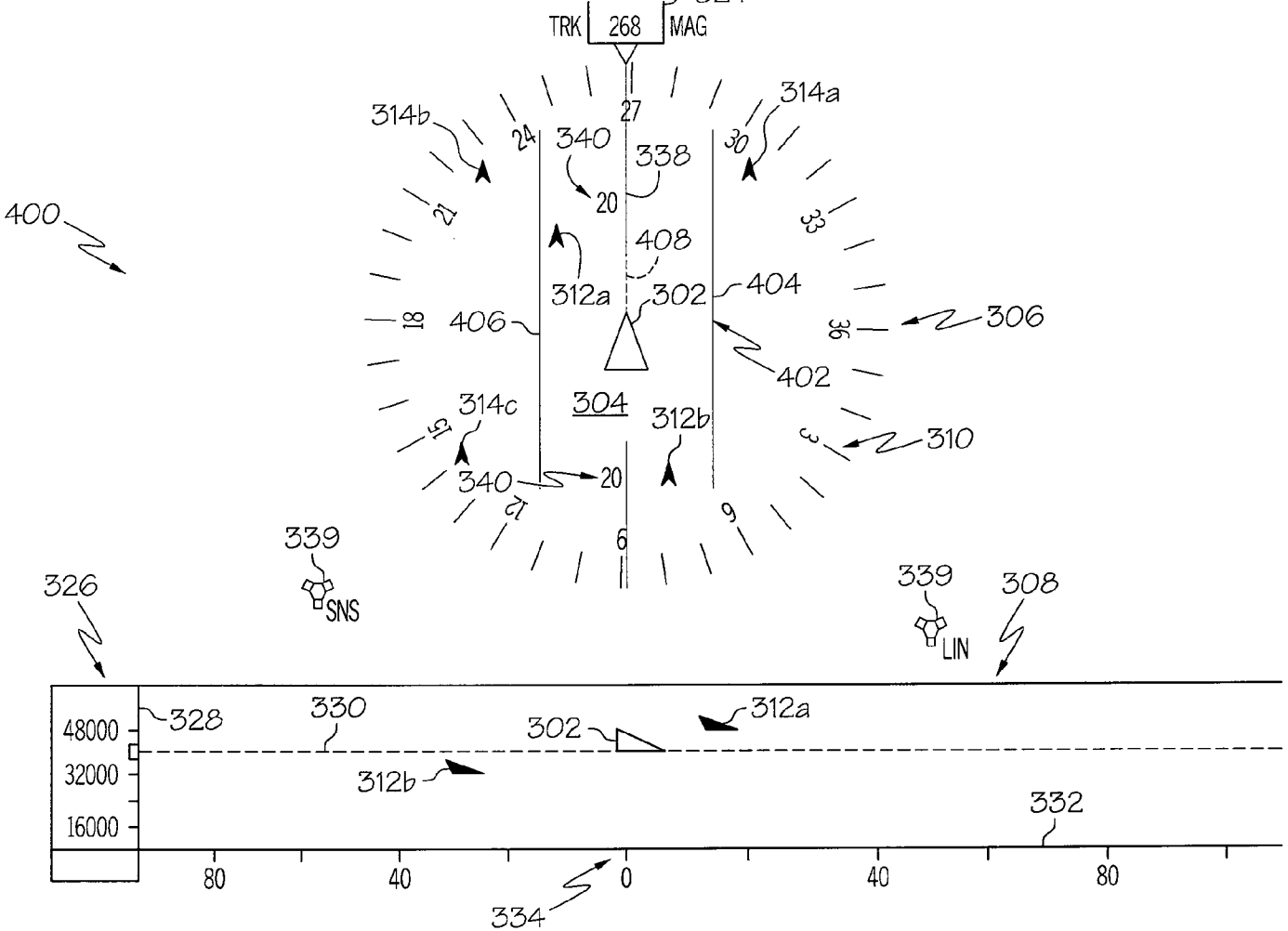
FIG. 4 is an illustration of the exemplary display for filtering relevant aircraft traffic and presenting the filtered traffic to a pilot in accordance with another embodiment of the present disclosure.
Figure 5:
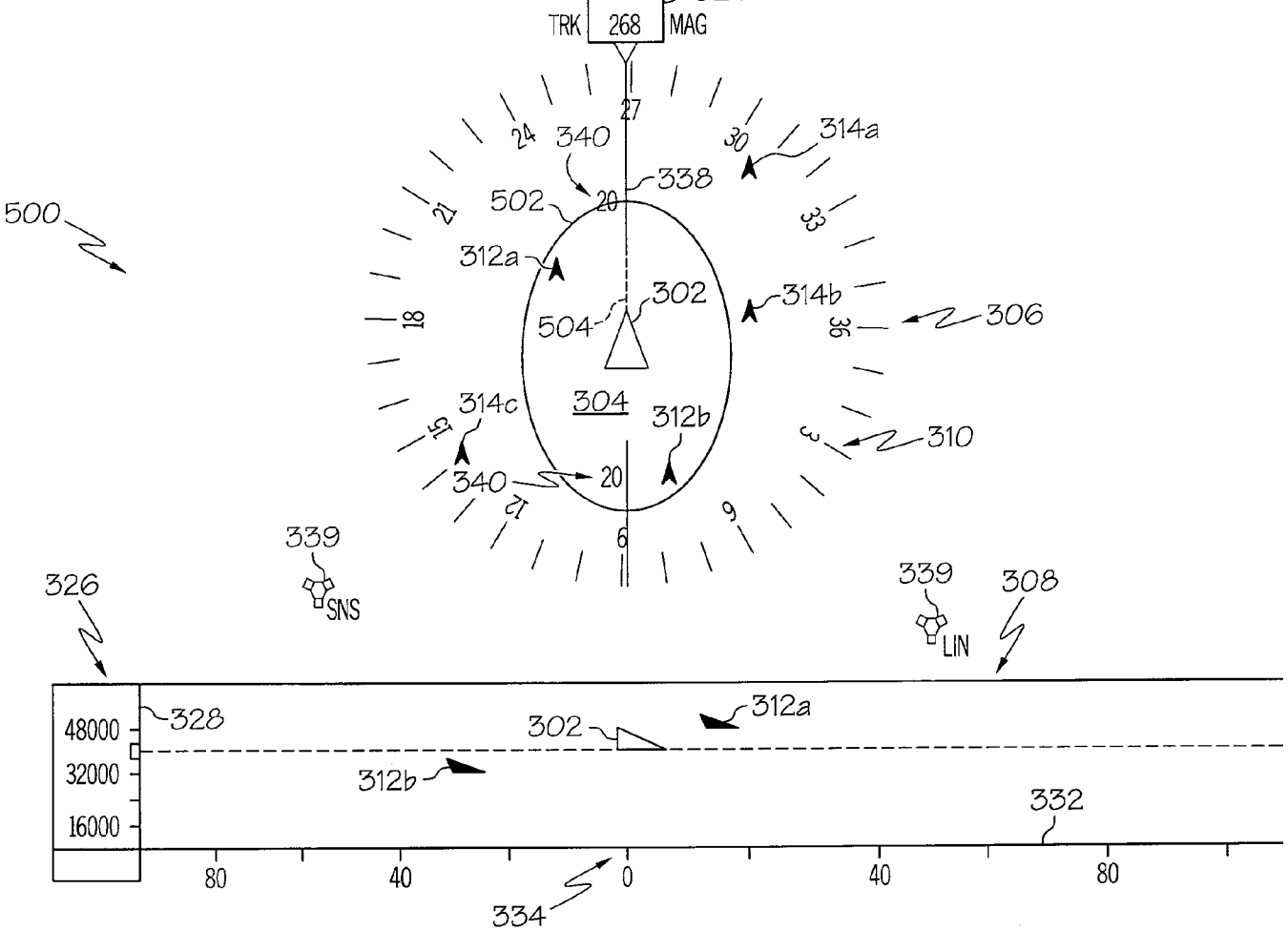
FIG. 5 is an illustration of the exemplary display for filtering relevant aircraft traffic and presenting the filtered traffic to a pilot in accordance with a further embodiment of the present disclosure.

The aircraft traffic may be represented in a graphical form similar to that illustrated in FIGS. 3, 4, and 5, or in a tabular form similar to that illustrated in FIG. 6. In another embodiment, the aircraft traffic may be represented in both a graphical form and a tabular form or the pilot or flight crew may be presented an option to select which form to present the representation of the aircraft traffic and a the manner for distinguishing the relevant aircraft traffic within the selected filtering airspace and the other aircraft traffic outside of the selected filtering airspace.

In block 112, a boundary may be presented in the display to represent the selected filtering airspace, filter range, or application range relative to the pilot's own aircraft. Examples of different types of boundaries to represent the selected filtering airspace will be described with reference to FIGS. 4 and 5.

In accordance with an embodiment, the selected filtering airspace may be selectively offset relative to the pilot's own aircraft. For example, the pilot may select an option that the selected filtering airspace extends a predetermined distance in front, behind or in all directions of the aircraft to provide a greater range of the selected filtering airspace in a direction ahead of the direction of travel of the pilot's own aircraft or in some other direction relative to the aircraft.

An option may also be presented or provided for the pilot or flight crew member to select to present only the relevant aircraft within the selected filtering airspace in the display or to limit a number of other aircraft outside of the selected filtering airspace based on a distance from the pilot's own aircraft to simplify the display and avoid presentation of unnecessary information. This may minimize the amount of clutter of other aircraft that may not be relevant to the pilot's own aircraft. A range of the selected filtering airspace may be adjusted manually by the pilot or automatically based on a stage of flight or flight transition, such as departure, cruise, approach or other stage, weather, or based on other conditions or criterion.

In accordance with another embodiment, a range of the selected filtering airspace may be automatically adjusted based on or in response to at least one of a number of relevant aircraft and other aircraft within the predetermined airspace and a stage or transition of flight of the pilot's own aircraft. For example, during approach and departure stages or transitions of flight near an airport, the range of the selected filtering airspace may be automatically adjusted to present only the relevant aircraft traffic within a predetermined range relevant to the vicinity of the airport where there may be significantly more aircraft traffic than in other stages or transitions of flight. During the cruise stage the range of the selected filtering airspace may be automatically expanded to cover a larger airspace. Increasing the filtering airspace range during cruise when aircraft speeds may be substantially faster relative to approach and departure may also improve situational awareness during such stages of flight. During approach and departure when aircraft speeds are slower and typically around airports where aircraft traffic may be increased a smaller filtering airspace may improve situational awareness.

In block 114, a determination may be made if there is a vertical situational display (VSD). For example, the pilot or flight crew may select to present the vertical situational display under certain circumstance or flight stages. If there is no VSD or the pilot has not selected this option, no VSD or vertical profile is presented in block 116. If the aircraft is equipped with a VSD, and/or the pilot has selected the VSD option, the VSD may be presented in block 118. The VSD may present only representations of the relevant aircraft traffic within the selected filtering airspace or filter range. Optionally, the VSD may also present representations of the other aircraft outside of the selected filtering airspace or the general traffic. An option may be presented for the pilot to select whether or not to also present the other aircraft or general traffic on the VSD. The other traffic outside of the selected filtering airspace may be distinguished from relevant aircraft traffic within the selected filtering airspace similar to that previously described or as will be described with reference to FIGS. 3, 4, 5, and 6.

Figure 2:
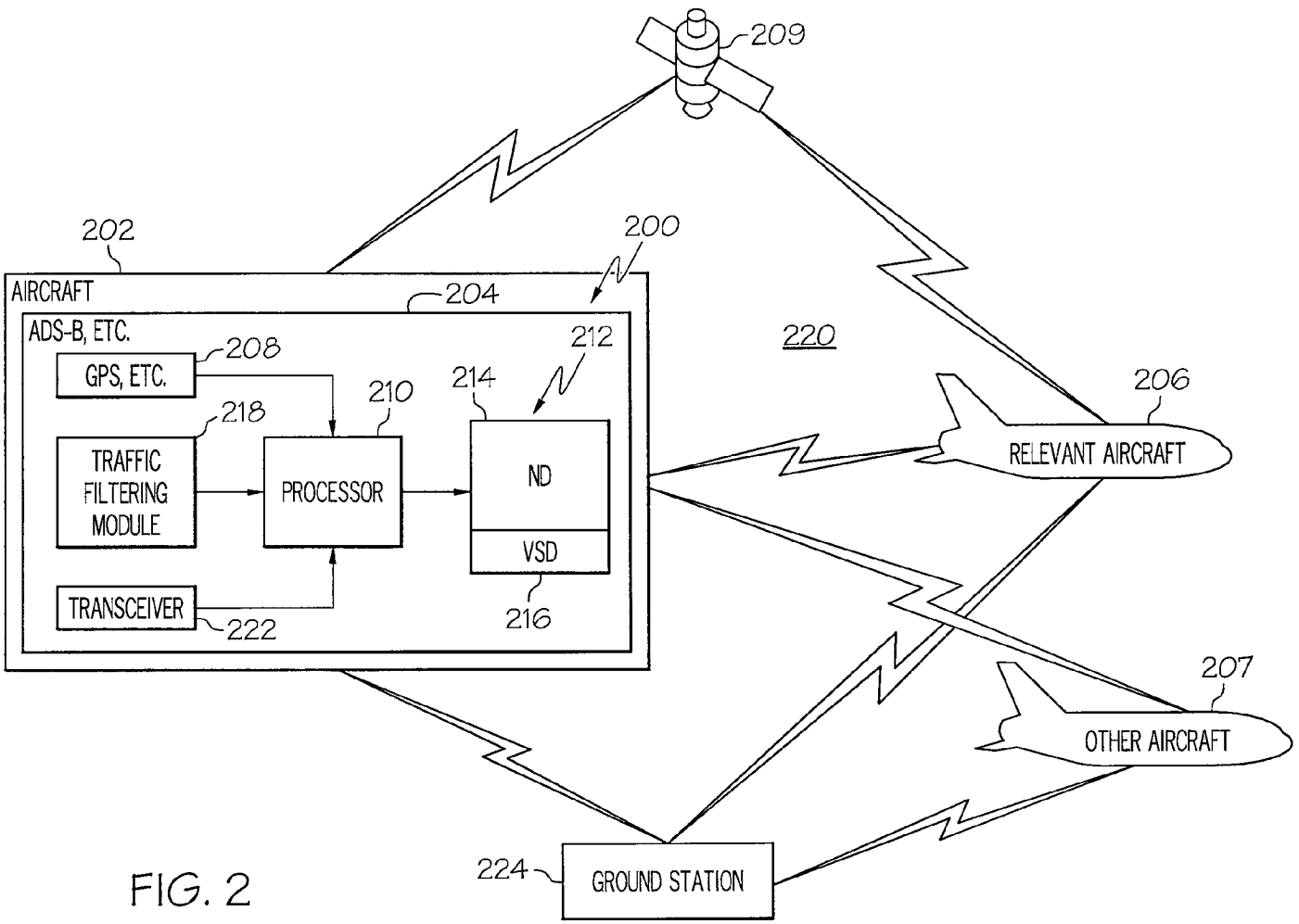
FIG. 2 is a block diagram of an exemplary system for filtering relevant aircraft traffic and presenting the filtered traffic to a pilot in accordance with an embodiment of the present disclosure.

FIG. 2 is a block diagram of an exemplary system 200 for filtering relevant aircraft traffic 206 and presenting the filtered traffic to a pilot or flight crew of an aircraft 202 in accordance with an embodiment of the present disclosure. The method 100 may be embodied in and performed by the system 200. The system 200 may be mounted in an airframe of an aircraft 202. The system 200 may include an electronic device 204 for determining flight data or information of other aircraft 206 within a predetermined airspace relative to the pilot's own aircraft 202.

The system 200 or electronic device 204 may be part of an Automatic Dependent Surveillance-Broadcast (ADS-B) type system or may include ADS-B technology or similar technology. ADS-B is a cooperative surveillance technique or technology for air traffic control and related applications. An ADS-B-equipped aircraft may determine its own position using a global navigation satellite system and periodically broadcasts the aircraft's position and other relevant information, such as altitude, airspeed, heading, vertical trend, etc., to ground stations and other aircraft with ADS-B equipment. ADS-B may be used over several different data link technologies, including but not limited to Mode-S Extended Squitter (1090 ES), VHF data link (VDL Mode 4), Universal Access Transceivers (UAT) and similar technologies.

The system 200 or electronic device 204 may include a global positioning system (GPS) 208 or similar apparatus for receiving signals or GPS information from GPS satellites 209 or other sources for determining the global location of the aircraft 202. The GPS information may also be used to determine other flight data or information similar to that described above.

The system 200 or electronic device 204 may include a processor 210 for controlling operation of the system 200 and for performing other functions and operations such as those described with respect to the method 100.

The system 200 or electronic device 204 may also include a display 212 to present a representation of the pilot's own aircraft 202 and a representation of the location of each of the relevant aircraft 206 within a predetermined airspace, as illustrated in FIGS. 3, 4 and 5 in relation to the pilot's own aircraft 202 (302 in FIGS. 3, 4, and 5). Other flight information associated with the other aircraft 207 may also be presented, such as altitude, vertical trend, airspeed, heading, etc.

The display 212 may include a navigational display (ND) 214 and a vertical situational display (VSD) 216. Examples of the ND 214 and the VSD 216 will be described with reference to FIGS. 3, 4, and 5. The ND 214 and the VSD 216 may be separate displays or may be different portions of a single display. The VSD 216 may be selectively presented by the pilot selecting an option to show the VSD 216. When the VSD option is selected by the pilot, the ND 214 may automatically shrink to occupy a smaller area of the single display 212 with the VSD 216 being presented in a portion of the display 212 vacated by the shrinking ND 214.

The system 200 or electronic device 204 may also include an aircraft traffic filtering module 218. The aircraft traffic filtering module 218 may filter the relevant aircraft 206 within a selected filtering airspace 220 relative to the pilot's own aircraft 202 and may present a representation of the relevant aircraft 206 within the selected filtering airspace 220 in a selected format to distinguish the relevant aircraft 206 within the selected filtering airspace 220 from other aircraft 207 that may be presented in the display 212. The aircraft traffic filtering module 218 may perform some or all of the functions or operations described with regard to the method 100 or may perform similar functions and operations to method 100. The method 100 may be embodied in the aircraft traffic filtering module 218. The aircraft traffic filtering module 218 may run or operate on the processor 210.

The system 200 or electronic device 204 may also include a transceiver 222, for sending and receiving location, altitude and other flight data and other information. The transceiver 222 may send flight data about its associated aircraft 202 to a ground station 224 or air traffic control (ATC) facility and to the relevant aircraft 206 and to the other traffic 207 and may receive flight data and information about the relevant aircraft 206 and other aircraft 207 from the relevant aircraft 206 and the other aircraft, and from the ground station 224. The flight data or information received may be used for filtering the aircraft or aircraft traffic and for presenting the filtered aircraft traffic or relevant aircraft traffic 206 in the display 212 as described herein.

FIG. 3 is an illustration of an exemplary display 300 for filtering relevant aircraft traffic and presenting the filtered traffic or relevant traffic to a pilot in accordance with an embodiment of the present disclosure. Similar to that previously described, the display 300 may include a navigational display (ND) 306 or ND display portion and a vertical situational display (VSD) 308 or VSD portion.

The ND 306 may be a horizontal display or planar view of the airspace surrounding the pilot's aircraft 302. The pilot's own aircraft 302 may be represented by a suitable icon or symbol in the ND 306 and VSD 308 to distinguish from the other symbols or aircraft that may be represented by icons or symbols in the display 300. For example, the pilot's own aircraft 302 may be represented by a substantially arrowhead shape in the ND 306 and by a substantially wedge shape in the VSD 308. The pilot's own aircraft 302 may also be a different color and size from other symbols to further highlight or distinguish the pilots own ship 302 in the ND 306 and VSD 308.

The pilot's own aircraft 302 or ship may be represented in substantially the center of a compass rose 310. The location of relevant aircraft 312*a*-312*c* and other aircraft 314*a*-314*c* may also be represented within a predetermined airspace surrounding the pilot's own aircraft 302. The predetermined airspace surrounding the pilot's own aircraft 302 may be defined by the compass rose 310. In other words, the predetermined airspace may be represented by the entire area within and around the compass rose 310. The pilot's own aircraft 302 may be represented by an arrowhead pointing in the direction of travel. A magnetic compass heading 316 of the pilot's aircraft 302 may be presented at a top portion of the compass rose 310. The relative location of the relevant aircraft 312*a*-312*c* and the other aircraft 314*a*-314*c* to the pilot's own aircraft 302 in the predetermined airspace is illustrated by the relative positions or locations of the relevant aircraft 312*a*-312*c* and the other aircraft 314*a*-314*b* in the compass rose 310 of the ND 306.

The VSD 308 is a vertical view or elevation view of the airspace. The VSD 308 represents the altitude and location of the pilot's own aircraft 302 and the location and altitude of relevant aircraft 312*a*-312*c* within the selected filtering airspace 304 relative to the pilot's own aircraft 302. An option may be provided for the pilot to select to show only the relevant aircraft 312*a*-314*c* within the selected filtering airspace 304 in the VSD 308 or to also show the other aircraft 314*a*-314*c*.

A representation of other aircraft 314*a*-314*c* within the predetermined airspace in the ND 306 and the VSD 308 may be presented in at least one of a different color or a different shape within the airspace to distinguish from other aircraft in the display 300. For example, the relevant aircraft 312*a*-312*c* may be illustrated in FIG. 3 in one color or shape to represent that they are within the selected filtering airspace 304. The representation of other aircraft 314*a*-314*c* may be illustrated in a different color or shape in FIG. 3 to represent that they are outside of the selected filtering airspace 304. In another embodiment, an icon or one type of icon may be associated with each aircraft 312*a*-312*c* within the selected filtering airspace 304 and no icon or a different type icon may be associated with each aircraft 314*a*-314*c* within the predetermined airspace within the compass rose 310 in the display 300 but outside of the selected filtering airspace 304. Relevant aircraft 312*a*-312*c* within the selected filtering airspace 304 may be represented by any combination of a different color, shape or icon compared to other aircraft 314*a*-314*c* outside of the selected filtering airspace 304 to distinguish between the relevant aircraft traffic 312*a*-312*c* and the other aircraft 314*a*-314*c*.

The VSD 308 may also include an indicator 326 of the altitude of the pilot's own aircraft 302 and relevant aircraft 312*a*-312*c*. The altitude indicator 326 may include a vertical scale 328 (illustrating altitudes or flight levels). The representation of the pilot's own aircraft 302 may be distinguished by residing on or being associated with a dashed or broken line 330 from the vertical scale 328 at a level corresponding to the altitude or flight level of the pilot's own aircraft 302.

The VSD 308 may also include a range scale 332 or line for the pilot to determine a range or distance from his aircraft 302 to each of the relevant aircraft 312*a*-312*c*. The pilot's own aircraft 302 is shown at a range indication 334 of "0" on the range scale 332 which illustrates both distances ahead and behind the pilot's aircraft 302.

A range of the selected filtering airspace 304 may be represented in the ND 306 by a line 338 extending from the representation of the pilot's own aircraft 302 to the magnetic compass heading representation 316 of the pilot's aircraft 302, and also to the bottom of the compass rose 310 in the ND 306. A numerical indication 340 may also be presented adjacent the range line 338 to indicate the range of the selected filtering airspace 304. The numerical range indication 340 may be in nautical miles.

The ND 306 may also include an icon or indicator for each navigation aid or navaid 339 and other icons for other artifacts or points of possible interest to the pilot.

Options may also be presented for the pilot to select a range for the predetermined airspace to be presented in the ND 306 and VSD 308 and for the pilot to select the range for the selected filtering airspace 304 within the predetermined airspace. The options may be presented by the traffic filtering module 218 similar to that previously described or may be controls forming part of the display 212 in FIG. 2 or 300 in FIG. 3.

The VSD 308 may also display a terrain profile (unless the aircraft is over the ocean or other body of water. An example of a terrain profile 345 is illustrated in FIG. 3.

FIG. 4 is an illustration of an exemplary display 400 for filtering relevant aircraft traffic and presenting the filtered traffic to a pilot in accordance with another embodiment of the present disclosure. The display 400 may be the same as or similar to the display 300 in FIG. 3 and may include similar features as described with reference to FIG. 3. In the display 400, a boundary 402 may be presented in the ND display 306 to represent the selected filtering airspace 304, filter range or application range for filtering and presenting relevant aircraft traffic 312*a*-312*b* to the pilot or flight crew. The boundary 402 in the display 300 may include presenting a pair of parallel lines 404 and 406 on each side of the representation of the pilot's own aircraft 302. The pair of parallel lines 404 and 406 may correspond to a chosen lateral distance on either side the pilot's own aircraft 302 along an intended flight path 408 of the pilot's own aircraft 302 defining the selected filtering airspace 304. The amount of airspace or distance between the lines 404 and 406 actually representing or defining the selected filtering airspace 304 may be selected by the pilot or may be adjusted automatically from the information from a database, based on conditions, such as stage of flight, weather conditions or other conditions or criteria.

FIG. 5 is an illustration of an exemplary display 500 for filtering relevant aircraft traffic and presenting the filtered traffic to a pilot in accordance with a further embodiment of the present disclosure. The display 500 may be the same as or similar to the display 300 in FIG. 3 and may include similar features as described with reference to FIG. 3. In the display 500, the selected filtering airspace 304 may be represented or defined by an ellipse 502 or another type boundary surrounding the representation of the pilot's own aircraft 302. A major axis of the ellipse 502 may correspond to an intended flight path 504 of the pilot's own aircraft 302. Similar to that previously described, the airspace within the ellipse 502 or other boundary defining the filter range may be selected by the pilot or may be selected automatically from a database, depending upon the stage or transition of flight and other conditions or criteria as described herein.

Similar to that previously described, options may be provided or presented in the display 300, 400, or 500 or may be provided in association with the display for the pilot to select to present only the relevant aircraft 312*a*-312*c* within the selected filtering airspace 304 in the display or to limit a number of other aircraft 314*a*-314*c* outside of the selected filtering airspace 304 based on a distance from the pilot's own aircraft or based on other criterion to simplify the display and avoid presentation of unnecessary information. The display may be set to automatically display only the relevant aircraft within the selected filtering airspace and other aircraft within a preset distance outside of the selected filtering airspace to reduce the number of other aircraft being displayed. A feature may be provided to automatically adjust a range of the selected filtering airspace in response to at least one of a number of other aircraft within the predetermined airspace and/or a stage or transition of flight of the pilot's own aircraft or other conditions, such as type of airspace, weather, similar to that previously described.

Accordingly, by identifying relevant aircraft traffic (aircraft that may be a concern to the pilot or flight crew) on the ND 306, the number of aircraft that need to be displayed on the VSD 308 for the flight crew situational awareness (VSD has a relatively smaller display area as previously described) is reduced to a more "readable" format. This helps the pilots or flight crew to identify the reference or relevant aircraft to the air traffic controller while asking for flight level change clearances in oceanic or procedural airspace or to assist the pilots or flight crews with other maneuvers or procedures. Without this filtering, it would be difficult and time consuming for the flight crew to correctly identify the relevant traffic and to obtain information needed for flight planning e.g. flight level change etc.

The relevant airspace (lateral spacing between airplanes) along a route can be stored in an aircraft database or the like, or the relevant airspace can be manually entered by the flight crew for a flight or it can be uploaded by a controller, operation center, or other facilities. This lateral spacing may be a fixed value or may change depending upon meteorological conditions or other conditions. The filtered airspace 304 may be based on or determined from the relevant airspace.

FIG. 6 is an example of a presentation in a display of a representation of aircraft traffic in a tabular form 600 or table and representation of aircraft within a selected filtering airspace of a pilot's own aircraft in a selected format to distinguish from other aircraft in the display. Similar to that previously described, in the tabular form 600, the representation of relevant aircraft traffic within the selected filtering airspace may be presented in a selected format to distinguish from the other aircraft outside of the filtering airspace. Examples of the selected formats to distinguish from the other aircraft in the display may include: presenting the relevant aircraft within the selected filtering airspace on top of the tabular form 600;

presenting the relevant aircraft within the selected filtering airspace in a different font in the tabular form 600; and presenting the relevant aircraft within the selected filtering airspace in a different font color in the tabular form; and presenting an icon in association with each of the relevant aircraft within the selected filtering airspace. In the example illustrated in FIG. 6, the relevant aircraft 602 within the selected filtering airspace are shown at the top or in the upper row or rows of the tabular form 600. In FIG. 6, the relevant aircraft 602 within the selected filtering airspace are also illustrated in bold italicized type which may also correspond to a different font or color.

The tabular form 600 may include but is not limited to columns for entering flight identification, a bearing, a range, an altitude and any other information or data that may be of interest to the pilot or flight crew for each relevant or other aircraft corresponding to a different row of the tabular form 600. The tabular form 600 may be presented by itself or also in conjunction with one of the displays 300, 400, 500, or 600. An option may be presented for the pilot to select different combinations of the displays 300, 400, 500 or 600 for presentation.

The flowchart and block diagrams in the Figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Although specific embodiments have been illustrated and described herein, those of ordinary skill in the art appreciate that any arrangement which is calculated to achieve the same purpose may be substituted for the specific embodiments shown and that the embodiments herein have other applications in other environments. This application is intended to cover any adaptations or variations of the present disclosure. The following claims are in no way intended to limit the scope of the disclosure to the specific embodiments described herein.

What is claimed is:

1. A method for filtering and presenting relevant aircraft traffic to a pilot, comprising:

determining a location and altitude of aircraft within a predetermined airspace relative to the pilot's own aircraft;

presenting a representation of the pilot's own aircraft and a representation of the location of each of the aircraft within the predetermined airspace in relation to the pilot's own aircraft on a display to the pilot;

filtering relevant aircraft within a selected filtering airspace relative to the pilot's own aircraft from other aircraft; and presenting the representation of the relevant aircraft within the selected filtering airspace in a selected format to distinguish the relevant aircraft within the selected filtering airspace from any other aircraft presented in the display.

2. The method of claim 1, wherein presenting the representation of the relevant aircraft within the selected filtering airspace in a selected format to distinguish from the other aircraft presented in the display comprises at least one of:

presenting the representation of the relevant aircraft within the selected filtering airspace in a different color from the other aircraft presented in the display to distinguish the relevant aircraft within the selected filtering airspace from the other aircraft;

presenting the representation of the relevant aircraft within the selected filtering airspace in a different shape from other aircraft presented in the display to distinguish the relevant aircraft within the selected filtering airspace from the other aircraft; and resenting an icon in association with each representation of the relevant aircraft within the selected airspace to distinguish from other aircraft in the display.

3. The method of claim 1, further comprising offsetting the selected filtering airspace relative the pilot's own aircraft to provide a greater range of the selected filtering airspace in a direction ahead of a direction of travel of the pilot's own aircraft.

4. The method of claim 1, further comprising presenting a boundary in the display to represent the selected filtering airspace relative to the pilot's own aircraft.

5. The method of claim 4, wherein presenting the boundary in the display comprises presenting a pair of parallel lines on each side of the representation of the pilot's own aircraft, wherein the pair of parallel lines corresponds to a chosen lateral distance on either side the pilot's own aircraft along an intended flight path of the pilot's own aircraft defining the selected filtering airspace.

6. The method of claim 4, wherein presenting the boundary in the display to represent the selected filtering airspace comprises presenting an ellipse surrounding the representation of the pilot's own aircraft, wherein a major axis of the ellipse corresponds to an intended flight path of the pilot's own aircraft, the ellipse defining the selected filtering airspace.

7. The method of claim 1, further comprising providing an option for the pilot to select to present only the relevant aircraft within the selected filtering airspace in the display or to limit a number of other aircraft outside of the selected filtering airspace based on a distance from the pilot's own aircraft to simplify the display and avoid presentation of unnecessary information.

8. The method of claim 1, further comprising automatically displaying only the relevant aircraft within the selected filtering airspace and only other aircraft within a preset distance outside of the selected filtering airspace to reduce the number of other aircraft being displayed.

9. The method of claim 1, further comprising automatically adjusting a range of the selected filtering airspace in response to at least one of a number of relevant aircraft and other aircraft within the predetermined airspace and a stage or transition of flight of the pilot's own aircraft.

10. The method of claim 1, further comprising presenting the representation of the pilot's own aircraft and the representation of the location of at least each of the relevant aircraft within the predetermined airspace within a compass rose of a navigational display.

11. The method of claim 1, further comprising presenting a vertical situational display representing the altitude of the pilot's own aircraft and the location and altitude of at least the relevant aircraft in relation to the pilot's own aircraft.

12. The method of claim 1, further comprising:

presenting a navigational display comprising the representation of the pilot's own aircraft and the representation of the location of at least each of the relevant aircraft within the predetermined airspace; and presenting a vertical situational display comprising a representation of the altitude of the pilot's own aircraft and the location and altitude of at least the relevant aircraft in relation to the pilot's own aircraft.

13. The method of claim 12, further comprising presenting only the relevant aircraft within the selected filtering airspace in the vertical situational display.

14. The method of claim 1, further comprising presenting the representation of each of at least the relevant aircraft in a tabular form, and wherein presenting the representation of the relevant aircraft within the selected filtering airspace in the selected format to distinguish from the other aircraft comprises at least one of:

presenting the relevant aircraft within the selected filtering airspace on top of the tabular form;

presenting the relevant aircraft within the selected filtering airspace in a different font in the tabular form;

presenting the relevant aircraft within the selected filtering airspace in a different font color in the tabular form; and presenting an icon in association with each of the relevant aircraft within the selected filtering airspace.

15. An aircraft comprising:

an airframe;

a system for filtering and presenting relevant aircraft traffic to a pilot of the aircraft, the system comprising:

an electronic device for determining a location and altitude of aircraft within a predetermined airspace relative to the pilot's own aircraft;

a display to present a representation of the pilot's own aircraft and a representation of the location of each of the aircraft within the predetermined airspace in relation to the pilot's own aircraft; and a traffic filtering module to filter relevant aircraft within a selected filtering airspace relative to the pilot's own aircraft and to present the representation of the relevant aircraft within the selected filtering airspace in a selected format to distinguish the relevant aircraft within the selected filtering airspace from any other aircraft presented in the display.

16. The aircraft of claim 15, further comprising a boundary presented in the display to represent the selected filtering airspace relative to the pilot's own aircraft.

17. The aircraft of claim 15, wherein the display comprises a vertical situational display representing the altitude of the pilot's own aircraft and the location and altitude of at least the relevant aircraft in relation to the pilot's own aircraft.

18. A computer program product for filtering and presenting relevant aircraft traffic to a pilot, the computer program product comprising:

a computer readable storage medium having computer readable program code embodied therewith, the computer readable program code comprising:

computer readable program code configured to determine a location and altitude of aircraft within a predetermined airspace relative to the pilot's own aircraft;

computer readable program code configured to present a representation of the pilot's own aircraft and a representation of the location of each of the aircraft within the predetermined airspace in relation to the pilot's own aircraft on a display to the pilot;

computer readable program code configured to filter relevant aircraft within a selected filtering airspace relative to the pilot's own aircraft; and computer readable program code configured to present the representation of the relevant aircraft within the selected filtering airspace in a selected format to distinguish the aircraft within the selected filtering airspace from any other aircraft presented in the display.

19. The computer program product of claim 18, further comprising computer readable program code configured to present a boundary in the display to represent the selected filtering airspace relative to the pilot's own aircraft.

20. The computer program product of claim 18, wherein the computer readable program code configured to present the representation of the relevant aircraft within the selected filtering airspace in a selected format to distinguish the relevant aircraft within the selected filtering airspace from other aircraft presented in the display comprises at least one of:

computer readable program code configured to present the representation of the relevant aircraft within the selected filtering airspace in a different color from the other aircraft presented in the display to distinguish the relevant aircraft within the selected filtering airspace from the other aircraft;

computer readable program code configured to present the representation of the relevant aircraft within the selected filtering airspace in a different shape from other aircraft presented in the display to distinguish the relevant aircraft within the selected filtering airspace from the other aircraft; and computer readable program code configured to present an icon in association with each representation of the relevant aircraft within the selected airspace to distinguish from other aircraft in the display.

* * * * *